United States Patent [19]

Legris et al.

[11] Patent Number: 5,007,769

[45] Date of Patent: Apr. 16, 1991

[54] METHOD AND DEVICE FOR ATTACHING A REMOVABLE GUIDE POST

[75] Inventors: Bernard Legris, Stavanger; Magne Oppedal, Hommersåk, both of Norway; Eric Traonmilin, Billere, France

[73] Assignee: Elf Aquitaine Norge A/S, Stavanger, Norway

[21] Appl. No.: 293,577

[22] Filed: Jan. 4, 1989

Related U.S. Application Data

[63] Continuation of Ser. No. 75,360, Jul. 20, 1987, abandoned.

[30] Foreign Application Priority Data

Jul. 22, 1986 [NO] Norway ..... 86-2945

[51] Int. Cl.[5] ..... E02B 17/00; E21B 43/10

[52] U.S. Cl. ..... 405/195; 166/341; 166/349

[58] Field of Search ..... 405/169, 188, 195, 224; 166/341, 342, 349

[56] References Cited

U.S. PATENT DOCUMENTS

| | | | |
|---|---|---|---|
| 4,391,331 | 7/1983 | Shotbolt | 166/342 |
| 4,400,112 | 8/1983 | Castel et al. | 405/224 |
| 4,591,296 | 5/1986 | Henderson et al. | 405/195 |
| 4,625,804 | 12/1986 | Allen | 405/195 X |

*Primary Examiner*—David H. Corbin

*Attorney, Agent, or Firm*—Brisebois & Kruger

[57] ABSTRACT

A guide base has at its corners, bolted on transition pieces, each having an outwardly projecting nose with a downwardly sloping bottom surface. A guide post connectable to the guide base has a cavity of a shape corresponding to the shape of the nose. During installation of the guide post, the guide post is suspended on a guide wire to the vicinity of the guide base and is then moved laterally toward the base to cause the nose to enter the cavity. A surface of the cavity cooperates with the nose to cause the guide post to be pulled laterally into firm engagement against the transition piece when the guide wire is pulled upwardly. A locking member can be inserted through the so mounted guide post to lock the post to the transition piece.

17 Claims, 4 Drawing Sheets

METHOD AND DEVICE FOR ATTACHING A REMOVABLE GUIDE POST

This is a continuation of application Ser. No. 075,360, filed July 20, 1987, and now abandoned.

The present invention relates to a method and a device for attaching a removable guide post to a guide base for an offshore hydrocarbon well installation on the sea floor.

BACKGROUND OF THE INVENTION

When drilling wells of this type, it may be desirable to leave the well for a shorter or longer time. This may e.g. be the case for exploration wells or test wells, but may also be the case for production wells drilled by means of a floating drilling vessel before a more or less permanent production platform can be placed on the site. Under such circumstances, months or years may pass from finished drilling or testing of the well to reopening of the well for further use.

In order to protect the well heads of such wells in the meantime, it may be advantageous to cover these by means of a suitable cap or the like in order to prevent them from being damaged by fishing tackle or other equipment being dragged along the sea floor. However, such a protection cap would be excessively large if it also would have to cover the guide posts on the guide base. It would therefore be advantageous if the guide posts could be made removable so that they may be removed when the protection cap has been brought in place and later be installed when the well is to be reopened.

Removable guide posts are previously known, e.g. from U.S. Pat. No. 4,439,068. The purpose of these previously known posts has often been to permit replacement if they for some reason or other should have been damaged in use. For this purpose, the guide posts usually have a connecting system, with a female element in the form of a socket or sleeve arranged on the guide base and a male element or spigot on the lower end of the guide post itself fitting into the socket. In order to hold the spigot in place in the socket, engagement means are usually arranged, e.g. in the form of wedges, which are movable into engagement with suitable slots for locking the guide post to the guide base.

Such previously known systems are relatively complicated and comprise many movable parts which are arranged with relatively small clearance in order to function according to their purpose. These factors reduce the reliability i.a. because sand and other fine particles that may be stirred up from the bottom can penetrate between the parts and cause friction or jamming. Furthermore, these systems are not very suitable for applications where the guide posts stay dismounted for longer periods. Under such circumstances drifting particles and marine growth may deposit in the sockets, and even by means of a diver it would be difficult to clean the socket to a sufficient extent for it to receive the spigot on the guide post. Such cleaning would be almost impossible if, instead of divers, it would be necessary to use a remotely operated underwater vehicle, because its external manipulators would not get sufficient access to the narrow space constituted by the socket.

SUMMARY OF THE INVENTION

Thus, one of the objects of the present invention is to provide a method for attaching a removable guide post to a guide base, which can be performed in a relatively simple manner, preferably without the use of divers, even if a long time has passed since the guide post was removed.

According to the invention, this is obtained with a method for attaching a removable guide post to a guide base for an offshore hydrocarbon well installation on the sea floor, the connection between the guide post and the guide base including at least one male element co-operating with a corresponding female element and engagement means locking the elements together, comprising the steps of lowering the guide post suspended at the end of a guide wire from a surface structure or vessel to the vicinity of the guide base, connecting the male and female elements by bringing them into co-operating relationship, and activating the engagement means, characterized by, when connecting said elements, moving the guide post laterally towards the guide base for aligning at least one protrusion on the guide base with a corresponding cavity in the guide post, and exerting tension in said guide wire, thus causing limited vertical movement of the guide post with respect to the guide base, whereby said at least one protrusion enters said corresponding cavity.

Since one basically only has to move the guide post sidewise in order to align its cavity with the protrusion on the guide base, this can be done without the use of large forces or advanced equipment. On the other hand, large forces are available when exerting tension in the guide wire for causing the final connection between the elements. A futher advantage is that movable parts are avoided, at least if the tension in the guide wire can be maintained at all times. If this cannot be guaranteed, the elements may easily be locked to each other by introducing engagement means from the outside into aligned openings in the guide post and the guide base, said openings preferably being located above said cavity and protrusion.

The movement of the guide post against the guide base and the activation of the engagement means may according to the invention advantageously be performed by a remotely operated submarine vehicle. Since the guide post is moved sidewise from the outside against the guide base, the submarine vehicle will have ample space for the required maneuvering, and since the protrusion on the guide base necessarily must face outwards, the manipulators of the submarine vehicle may easily gain access for removing marine growth that may have deposited on the protrusion while not in use.

The invention also relates to a guide base for an offshore hydrocarbon well installation on the sea floor, having at least one removable guide post connectable thereto by means of a connecting system comprising at least one male element co-operating with a corresponding female element, and engagement means locking the elements together, characterized in that said at least one male element is arranged on the guide base and comprises a protrusion preferably having a tapered configuration, in that said female element is arranged on the guide post and comprises a cavity having a form complementary to that of the protrusion, and in that said engagement means are activatable from the outside of said elements.

This provides for a very simple and reliable structure compared to the previously known systems.

According to the invention it is regarded as advantageous that the protrusion is arranged on a generally vertical surface on the guide base, said protrusion having an outward and downward sloping bottom surface. Thus, the guide post will be pulled inwards against the guide base when tension is exerted in the guide wire during mounting of the guide post, and the greater the load in the guide wire, the more solid the connection between the guide post and the guide base will be.

According to the invention it is also suggested to provide the protrusion with an upper surface sloping downwards at a larger angle than the bottom surface. Thereby the protrusion will have a form causing the guide post to more or less automatically release itself from the guide base when the tension in the guide wire subsides. The sloping angle for the top and bottom surfaces of the protrusion may advantageously be at least 30° and 15°, respectively.

In order to facilitate the movement of the guide post towards the guide base during the connection, it is suggested according to the invention that the guide base, near said generally vertical surface, be provided with an attachment handle for a remotely operated submarine vehicle. By means of this handle the submarine vehicle may hold on to the guide base with one of its manipulators while the other manipulator grips the guide post and moves it in place.

For giving also the engagement means a simple and functional form, it is suggested according to the invention that the engagement means comprise aligned bores in said elements, into which a key member is insertable from the outside, the key member having at its inner end a catch, which, by turning the key, is engageable behind an inner wall in the guide base to prevent inadvertant removal of the key, an excentric weight on the external end of the key resisting turning of the key to the unengaged position of the catch.

According to a further advantageous feature of the invention, the female element is arranged in a generally flat, lower part of the guide post, and the male element is arranged on a transition piece bolted to the guide base. With a female element having this form, one may obtain a relatively large and precise surface for abutment against the guide base, and by arranging the male element on a transition piece, the removable guide post according to the invention may also be used for already existing guide bases designed for permanent guide posts.

For better understanding of the invention, it will be described more closely with reference to the exemplifying embodiment shown in the appended drawings.

DETAILED DESCRIPTION

Figure 1:
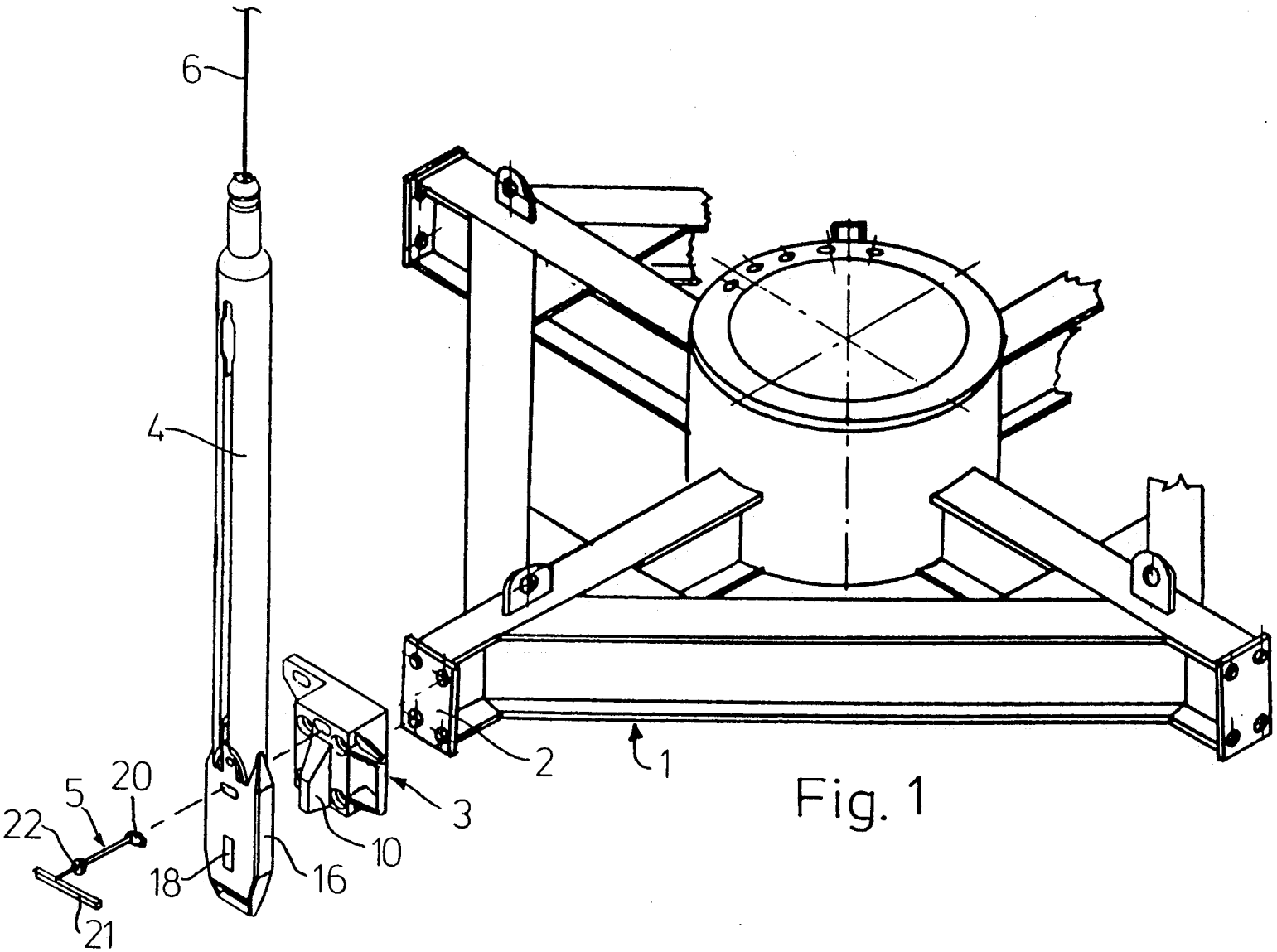
FIG. 1 shows a perspective exploded view of a guide base having a transition piece and a guide post according to the invention.
Figure 2:
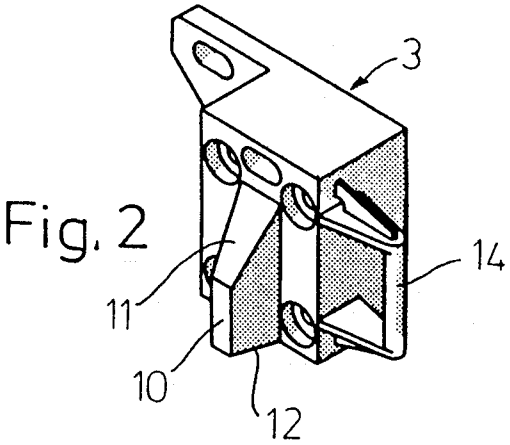
FIG. 2 shows the transition piece of FIG. 1 on a somewhat larger scale.
Figure 4:
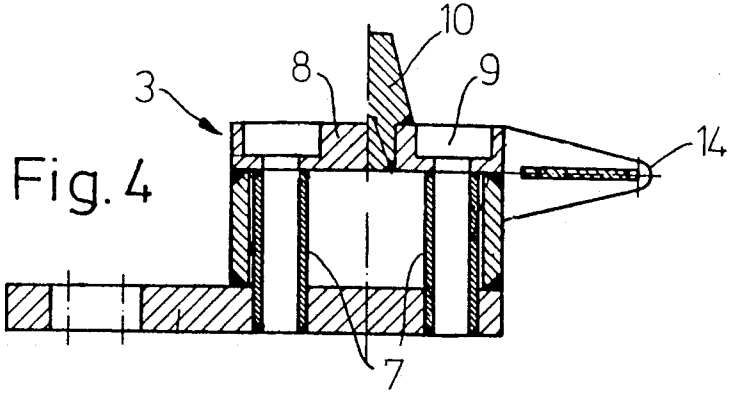
FIG. 4 shows a section along the line IV—IV in FIG. 3.
Figure 5:
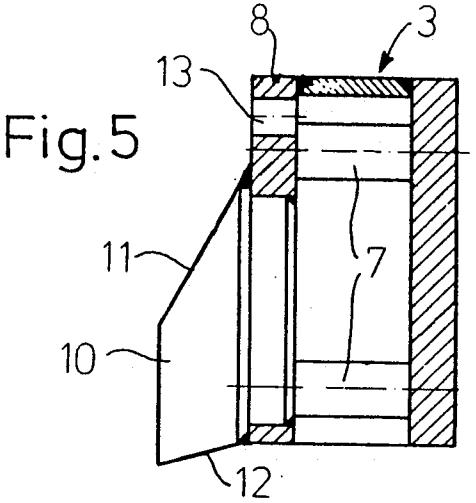
FIG. 5 shows a section along the line V—V in FIG. 3.
Figure 3:
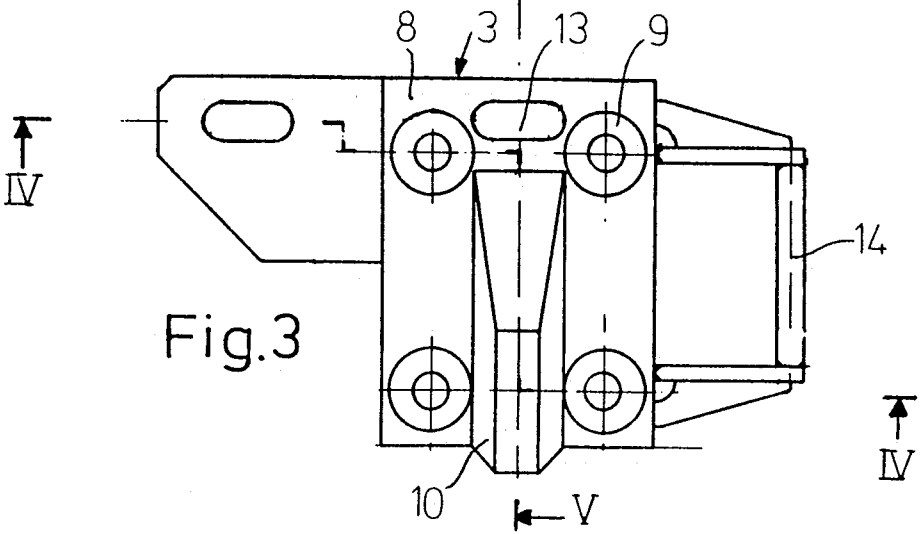
FIG. 3 shows the transition piece of FIG. 2, seen in side view on a somewhat larger scale.

In FIG. 1 an ordinary guide base for an underwater well is shown. The guide base is generally designated 1 and is mainly of square shape. At the corners of the guide base a vertical plate 2 is arranged, having four holes for bolts used for attaching a common, permanent guide post. In the present case there is no guide post bolted to the plate 2, but instead a transition piece 3. (The bolts are not shown). A removable guide post is in turn attached to the transition piece 3 and is locked to it by means of an locking member 5. A guide wire 6 is attached to the guide post 4.

Further details of the transition piece 3 are shown in FIGS. 2–5. Here it will be seen that the transition piece is made of plates which are welded together. Pipe pieces 7 form guides for the attachment bolts, and in the upper plate 8 of the transition piece recesses 9 for the heads of the attachment bolts are arranged so that the heads will not extend beyond the outer surface of the outer plate.

To the outer plate 8 there is welded a male element 10 in the form of a nose-like protrusion. It tapers in the outward direction both in the horizontal plane and the vertical plane. Both the upper surface 11 and the lower surface 12 of the nose 10 slope downwards, the upper more than the lower. These angles of inclination should at least be 30° and 15°, respectively, and preferably larger than the friction angle between the material of the nose 10 and the material of the corresponding part of the guide post 4.

Above the nose 10 the outer plate 8 is provided with a through-going bore 13 for receiving the engagement member 5. On one of its sides the transition piece 3 is provided with a handle 14, forming a gripping point for a remotely controlled submarine vehicle, a so-called ROV.

Figure 6:
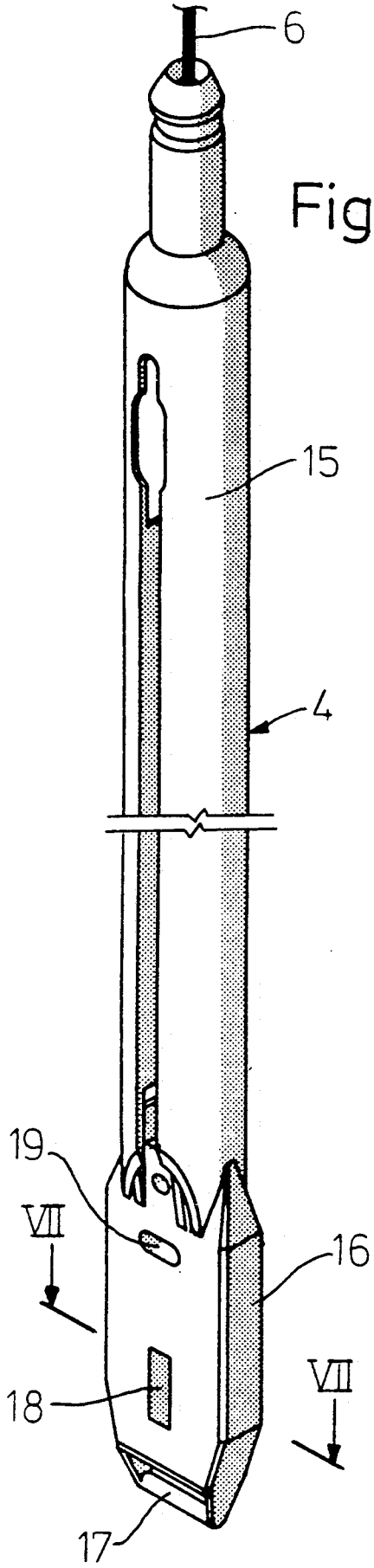
FIG. 6 shows in perspective the guide post of FIG. 1 on a somewhat larger scale.
Figure 8:
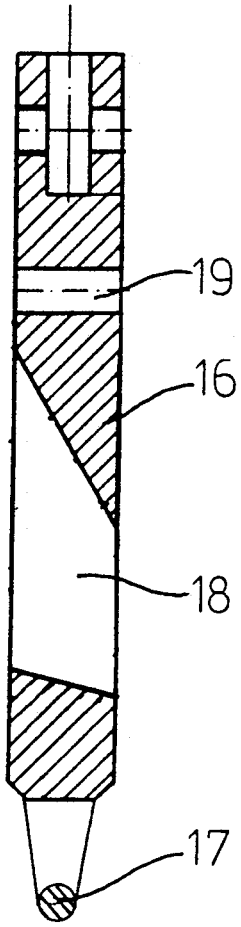
FIG. 8 shows a section along the line VIII—VIII in FIG. 7.
Figure 7:
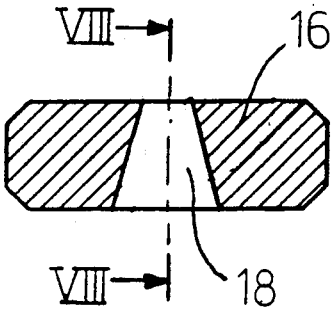
FIG. 7 shows a section on a larger scale along the line VII—VII in FIG. 6.

FIGS. 6–8 show details of the guide post 4. It has an elongate shaft 15 which is hollow and contains means for attachment of a guide wire 6. The shaft is at the bottom connected to a generally flat portion 16, which at its bottommost part is provided with a handle 17, likewise intended as a gripping point for a ROV.

As it best appears from FIGS. 7 and 8, the flat portion 16 of the guide post is provided with a cavity 18 having the same form as the nose-like protrusion 10 on the transition piece 3. When the guide post is brought together with the transition piece, the nose 10 will fill the cavity 18, and i.a. due to the sloping of the lower surface 12 of the nose 10, a form-locking effect will occur between these elements when tension is exerted in the guide wire 6.

Also the flat portion 16 of the guide post has a bore 19 for the locking member 5. From FIG. 1 it will be seen that at its inner end the locking member is provided with a catch 20 and at its other end has a handle 21, which also forms an eccentric weight. In the middle of the locking member a collar 22 is arranged. When the locking member is brought in through the bores 19 and 13, the collar 22 will abut against the outside of the flat portion 16 of the guide post. Concurrently, the catch 20 will be located slightly inside the bore 13 in the outer plate 8 of the transition piece 3. By turning the handle 21 from horizontal to depending vertical position, the catch 20 will grip behind the plate 8 and prevent withdrawal of the locking member 5. Thus, the transition piece 3 and the flat portion 16 of the guide post will be locked to each other.

Figure 9:
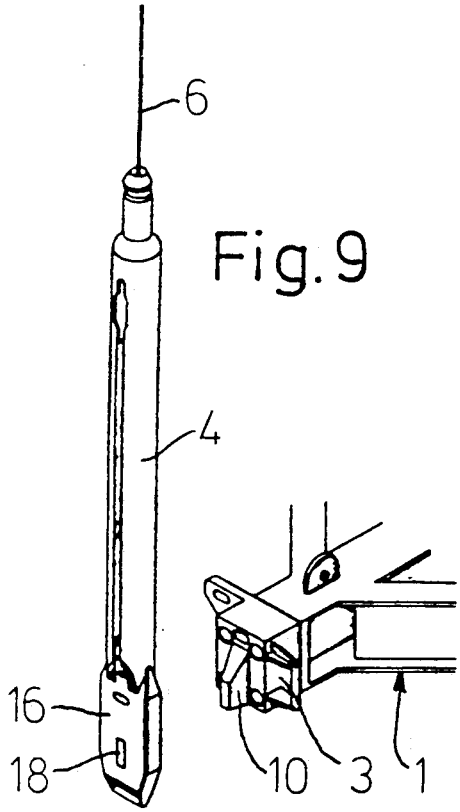
FIGS. 9–12 illustrate various phases of the connection of the guide post and the guide base shown in the preceding figures.
Figure 10:
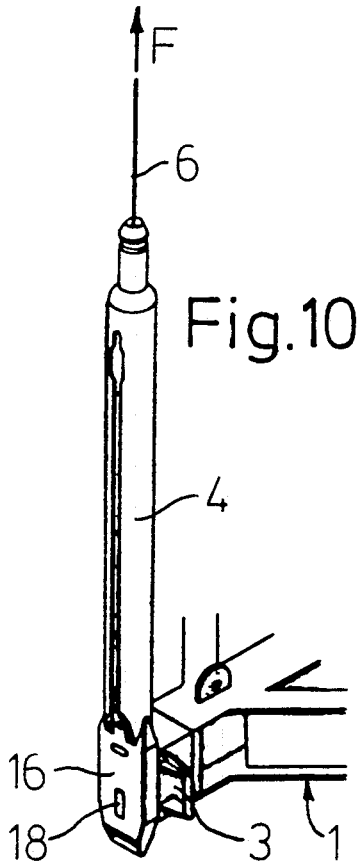
Figure 11:
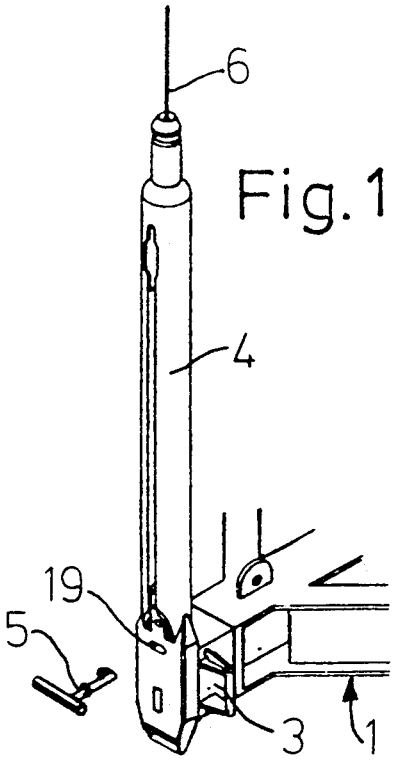
Figure 12:
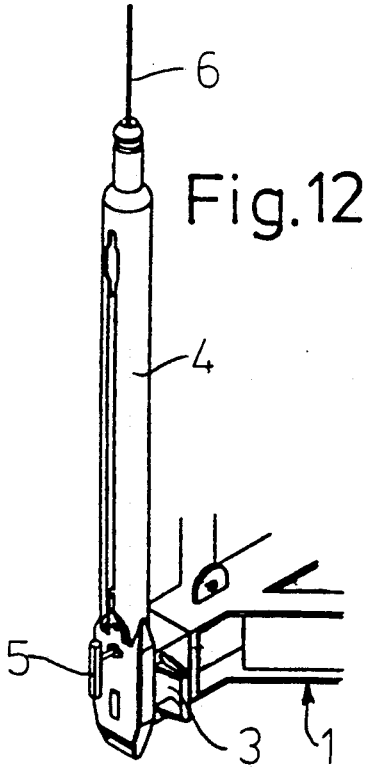

FIGS. 9-12 illustrate the various steps in the connection of the guide post to the guide base. Thus, FIG. 9 shows the guide post 4 suspended on the guide wire 6 at a small distance from the transition piece 3 on the guide base 1. E.g. by means of a ROV (not shown), the guide post thereupon is moved so that the nose 10 of the transition piece is aligned with and penetrates at last partially into the cavity 18 in the guide post. Then tension is exerted in the guide wire 6, as indicated by the arrow F in FIG. 10. During this stage, the flat portion 16 of the guide post, due to the special form of the nose 10 and the corresponding cavity 18, will be pulled into firm engagement against the outer plate 8 of transition piece 3. While the elements stay in this position, the locking member 5 is introduced in the holes 19 and 13 and is then pivoted so that the elements are locked together, as indicated in FIGS. 11 and 12.

When it is desirable to remove the guide post 4, the above operations are performed in the opposite sequence. First the locking member 5 is removed by pivoting it 90° and pulling it out. Thereafter, the guide wire 6 is slackened, causing the flat portion 16 of the guide post and the transition piece 3 to slide apart due to the sloping top surface 11 of the nose. If adhesion between the parts should have arisen, e.g. due to rust formation or larger amounts of marine growth, a lateral outward directed force against the guide post, e.g. exerted by means of a ROV, will easily free the guide post from the transition piece.

Even though the invention in the above is described in connection with a preferred exemplifying embodiment, it will be understood that the invention may be varied and modified in a number of ways by the skilled person within the scope of the following claims. Thus, for instance the form of the co-operating male and female elements may be varied. This may be done by giving the male element an outward diverging form in a horizontal section, while the female element is made as a vertical dove-tail slot on the inside of the lower portion of the guide post, said dove-tail slot being open in the top and closed at the bottom. Likewise, the engagement means may take many different forms, e.g. be made like a catch which is pivotably attached to the transition piece and is pivoted to grip lockingly behind a portion of the guide post.

We claim:

1. A method for attaching a removable guide post to a guide base of an offshore hydrocarbon well installation on the floor of a body of water comprising, the steps of, providing a protrusion extending laterally from a surface on the guide base, providing a cavity on the guide post for receiving the protrusion of the guide base to connect the guide post to the guide base, the cavity and protrusion having cooperating surfaces to cause the guide post to move laterally onto the protrusion in response to upward movement of the guidepost, lowering the guide post with a guide line from a surface station to suspend the guide post in the vicinity of the guide base, moving the guide post laterally to a position in which a lower surface of the projection is above an upwardly facing surface of the cavity, to generally align the protrusion on the guide base with the cavity of the guide post, and exerting tension on the guide line to lift the guide post and move the cavity of the guide post into connecting engagement with the protrusion on the guide base.

2. A method according to claim 1 further comprising, locking the guide post to the guide base after moving the cavity of the guide post into connecting engagement with the protrusion of the guide base.

3. A method according to claim 2 wherein said step of locking the guide post to the guide base comprises, positioning a locking element in aligned openings of the guide post and guide base while the cavity and protrusion are in connecting engagement.

4. A method according to claim 3 wherein said lateral movement of the guide post and said positioning of the locking element are adapted to be performed with a remotely operated vehicle.

5. A guide base for an underwater offshore hydrocarbon well installation comprising, a base adapted to be installed on the well, at least one removable guide post on said base, interengaging cooperation means on said guide post and base for connecting the guide post to the base in response to movement of the guide post laterally of the base to a connecting position on the base, said means comprising, a male element on said base and a female element on said guide post, and locking means for locking the guide post to the base in the connecting position.

6. A guide base according to claim 5 in which said male element comprises, a tapering male element which diverges toward the base, and said female element comprises a diverging female cavity of a form complimentary to the form of the male element.

7. A guide base according to claim 5 in which said male element comprises, a male element projecting laterally of a generally vertical surface of said base, said male element having an outwardly and downwardly sloping lower surface for camming said guide post toward the base in response to upward movement of the guide post relative to the base.

8. A guide base according to claim 7 in which said downwardly sloping lower surface of said male element slopes downwardly at an angle of at least 15 degrees.

9. A guide base according to claim 7 in which said male element further comprises, an upper surface which slopes downwardly at an angle greater the angle of said downwardly sloping lower surface.

10. A guide base according to claim 8 in which said downwardly sloping lower surface of said male element slopes downwardly at an angle of at least 15 degrees, and said downwardly sloping upper surface slopes downwardly at an angle of at least 30 degrees.

11. A guide base according to claim 5 further comprising, a handle for attachment of a remotely operated vehicle.

12. A guide base according to claim 5 wherein said locking means comprises locking means activatable from outside the guide base for locking the guide post to the guide base.

13. A guide base according to claim 12 wherein said locking means comprises an element extendable through an opening of the guide post into an aligned opening of the base, said element having catch means for engaging behind a surface of the base to lock the guide post to the base upon rotation of the catch means, and an eccentric weight on an outer end of the element for resisting rotation of the catch means to an unlocking position.

14. A guide base according to claim 5 wherein said female element comprises a female element in a generally flat upright lower portion of the guide post, and said male element projects from a generally flat surface which engages the flat surface of the guide post in the connecting position of the guide post on the base.

15. A guide base according to claim 14 wherein said male element is secured to a transition piece fastened to the guide base with fasteners.

16. A guide base according to claim 15 wherein said transition piece is bolted to the base.

17. A guide base according to claim 7 further comprising means for connecting a wire line to said guide post to lift the guide post into connecting position on said guide base.

* * * * *